US006381941B1

(12) United States Patent
Bucher

(10) Patent No.: US 6,381,941 B1
(45) Date of Patent: May 7, 2002

(54) CAPACITOR CHARGED YARN CUTTING APPARATUS

(75) Inventor: Cyrill Bucher, Bassersdorf (CH)

(73) Assignee: Zellweger Luwa AG, Uster (CH)

( * ) Notice: Subject to any disclaimer, the term of this patent is extended or adjusted under 35 U.S.C. 154(b) by 0 days.

(21) Appl. No.: 09/744,391

(22) PCT Filed: Jul. 19, 1999

(86) PCT No.: PCT/CH99/00329

§ 371 Date: Mar. 13, 2001

§ 102(e) Date: Mar. 13, 2001

(87) PCT Pub. No.: WO00/06479

PCT Pub. Date: Feb. 10, 2000

(30) Foreign Application Priority Data

Jul. 24, 1998 (CH) ..... 1561/98

(51) Int. Cl.[7] ..... B65H 63/06
(52) U.S. Cl. ..... 57/264; 30/162
(58) Field of Search ..... 30/162; 57/264

(56) References Cited

U.S. PATENT DOCUMENTS 3,901,015 A * 8/1975 Sangalli et al. ..... 57/1 R
5,384,963 A 1/1995 Beermann

FOREIGN PATENT DOCUMENTS

| | | |
|---|---|---|
| DE | 2132137 | 1/1973 |
| DE | 3112791 A1 * | 9/1982 |
| DE | 2232290 | 2/1988 |
| GB | 1600164 | 10/1981 |
| GB | 2193978 | 2/1988 |

* cited by examiner

*Primary Examiner*—Andy Falk
(74) *Attorney, Agent, or Firm*—Burns, Doane, Swecker & Mathis, LLP

(57) ABSTRACT

A method and apparatus for cutting yarn (9) on a textile machine having a blade (6) which is supplied with kinetic energy via a drive (2, 3, 4). To be able to generate at all times a sufficient yet not excessive cutting power the kinetic energy is delivered in doses and rated in accordance with properties of the yarn and/or device. The drive thus comprises a device (14) for rating the kinetic energy of the blade.

2 Claims, 2 Drawing Sheets

CAPACITOR CHARGED YARN CUTTING APPARATUS

BACKGROUND OF THE INVENTION

The invention relates to a method and a device for cutting yarn on a textile machine, with a blade, the blade being supplied with kinetic energy via a drive.

Devices of this type are more particularly arranged on textile machines, such as winding machines for example. Here, they are provided for cutting out faults, such as thick or thin areas in the yarn for example. The cutting is effected by means of a displaceably mounted blade, which forces the yarn against a brace and, once the yarn is resting against the brace, cuts said yarn. To this end, it is necessary for the blade to absorb sufficient kinetic energy before contacting the yarn. In this respect, it is usual to accelerate the blade to such a degree that it can rapidly cut through all conceivable yarns with its kinetic energy. Excess energy is dispelled on the brace. Or, the blade receives the amount of energy which is currently available depending on the given circumstances. In this case, the amount of energy supplied to the blade can vary arbitrarily.

In known devices, plunger-type or tilting armatures are used for the drive, the blade being connected to the armature.

A disadvantage of these known devices can be seen in that the cutting force of the blade is designed for the thickest yarn which is likely to be processed by the device, or the drive quite simply transmits its full power at all times, or the amount of power available at any one time. Practically, this results in the blade being excessively or too rapidly worn and in the device as a whole experiencing unnecessarily high vibrations.

BRIEF SUMMARY OF THE INVENTION

It is therefore the object of the invention to provide a method and apparatus which avoids these disadvantages and which always produces sufficient cutting force.

This is attained in that the kinetic energy is supplied in metered fashion and is measured as a function of a property from a group. This group comprises properties of the material from which the yarn is made, diameter, cross section, mass of the yarn, etc., as well as properties which are used for the cutting. One such property, for example, is the inertia of the mass displaced with the blade and of the blade per se, the characteristic of the frictional resistance of the moved blade etc.. A property such as the diameter, for example, or the cross section of the yarn is preferably measured directly prior to cutting, i.e. continuously, and the measured value is taken into account when measuring the supplied energy. Consequently, the drive comprises a device for measuring the kinetic energy of the blade.

The advantages which are hereby obtained can be seen in particular in that the blade, the brace or the anvil and in fact the entire device with the suspension is protected. In addition, undesirable secondary effects are prevented, such as excessive springing back of the blade, which impacts the brace with excessive surplus energy. Since the measurement of the kinetic energy can result in a restriction as well as an increase in the voltage applied to the drive, it is possible to carry out perfect cutting of the yarn even if the textile machine supplies insufficient voltage to the device.

BRIEF DESCRIPTION OF THE DRAWINGS

The invention will be explained in further detail in the following with the aid of an example and with reference to the enclosed drawings. In the drawings.

DETAILED DESCRIPTION OF THE INVENTION

Figure 1:
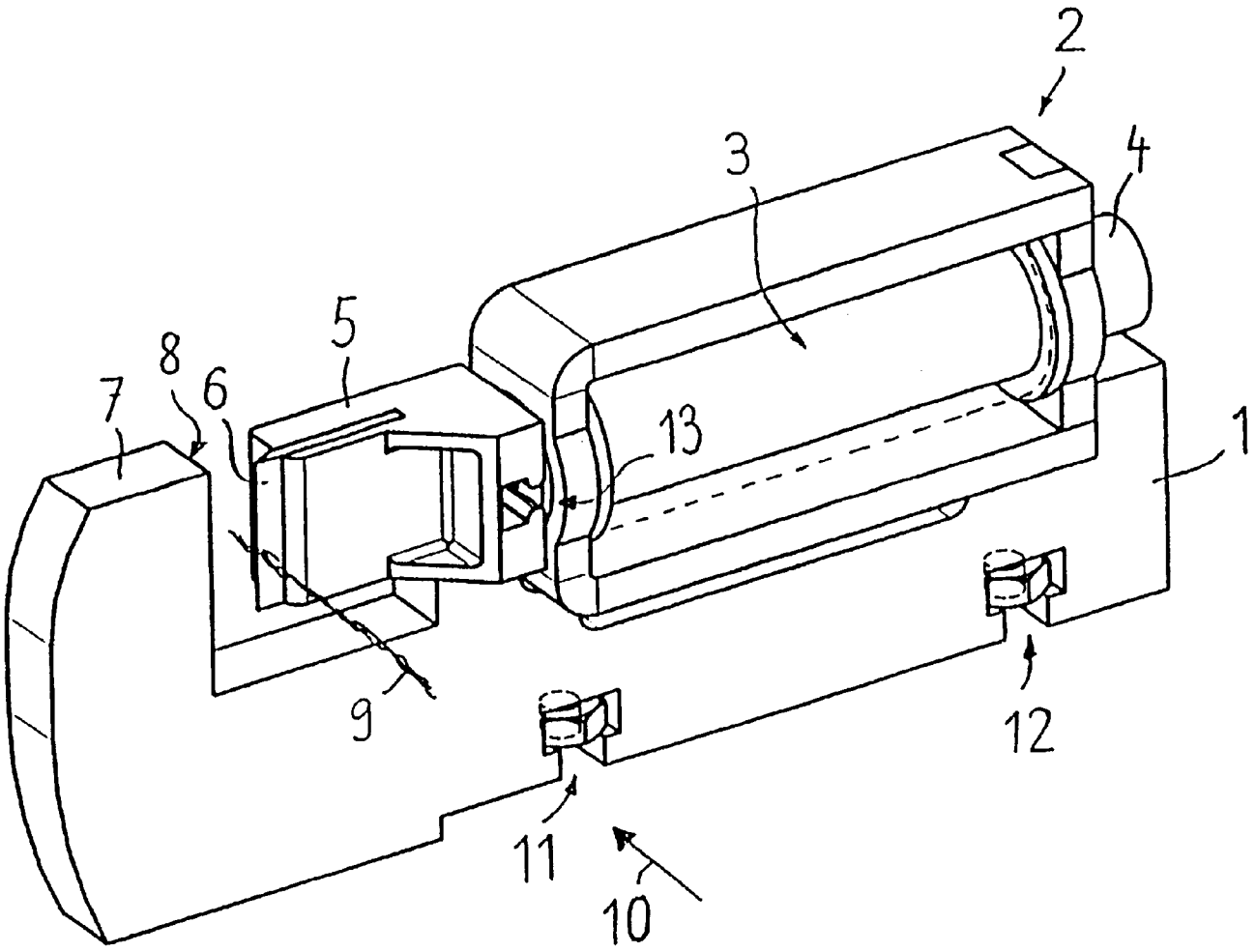
FIG. 1 is a perspective view of part of the device according to the invention.

FIG. 1 shows the most important parts of the device, more particularly a support 1, a plunger-type coil 2 with the coil 3 and the plunger-type armature 4, which form a drive for a blade holder 5 and therefore also for a blade 6 and a brace or an anvil 7, which is part of the support 1. The anvil 7 comprises a hardened surface 8, in front of which a yarn 9 passes, for example in the direction of an arrow 10. Recognisable on the support 1 are parts of two screw connections 11 and 12, by means of which the device can be secured to a textile machine. The blade 6 is preferably securely connected to the blade holder 5, which is in turn connected to the plunger-type armature 4, in this case via a releasable, positive-locking connection 13. It is known per se, and therefore not illustrated in further detail here, that the coil 3 comprises turns which are connected to a control circuit 14 not shown in this drawing.

Figure 2:
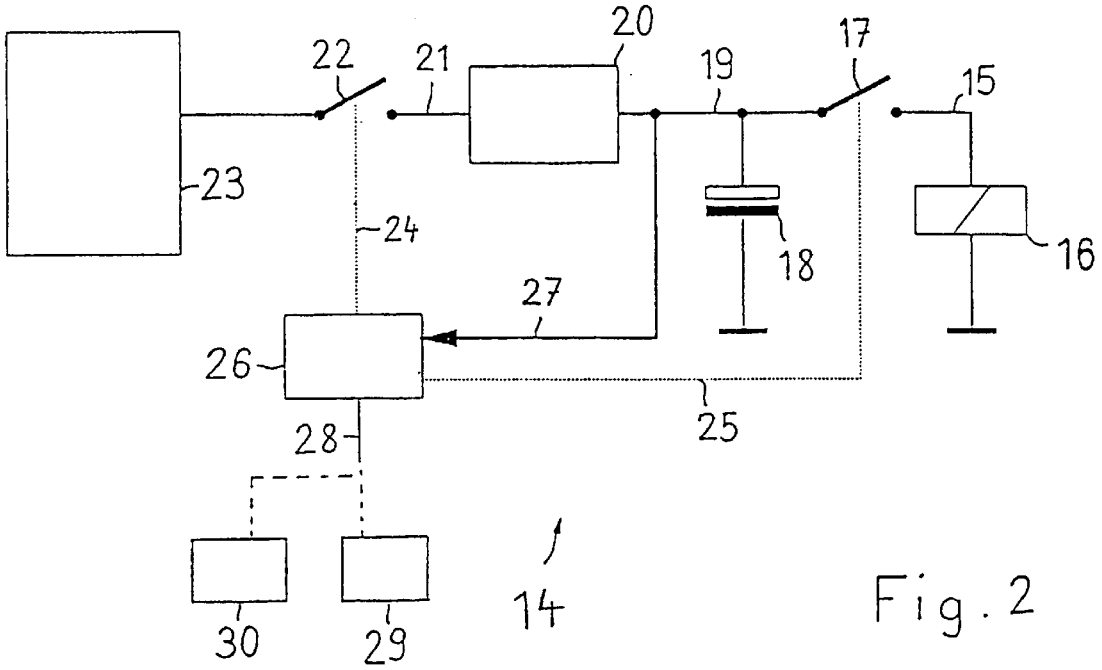
FIG. 2 is a circuit diagram of a further part of the device.

FIG. 2 shows a control circuit 14 as a device for measuring the kinetic energy of the blade 6, which is connected via a line 15 to a cutting device 16. The cutting device 16 is preferably constructed as shown in FIG. 1. In this respect, the line 15 is connected via a line 19 and a switching element 17 to an energy store 18, in this case constructed as a capacitor, which is in turn connected to a voltage transformer 20. This in turn is connected via a line 21 and a further switching element 22 to a supply circuit 23. The switching elements 22 and 17 are connected via lines 24 and 25 to a control 26, which additionally comprises two inputs 27 and 28. The input 27 is connected to the line 19 and the input 28 is connected either to a yarn measuring device 29 or a data input 30.

The voltage transformer 20 can be constructed, for example, as a d.c. transformer or as a charge pump. A microprocessor programmed according to the method of operation described below is preferably used for the control 26.

The method of operation of the invention is described as follows:

The supply circuit 23, which is part of a textile machine, for example, transmits a supply voltage of 30V–60V for example to the line 21 and the switching element 22. In the closed state, voltage is therefore supplied to the voltage transformer 20, which converts the applied voltage, i.e. increases or restricts the voltage, and charges the capacitor 18 via the line 19. A signal, which indicates a property of the yarn and/or of the device (inertia, friction, etc.), is applied to the control 26 at the input 28. On the one hand, this type of yarn property can be a function of the quality of the material, or can be a function of the quantity of material. Belonging to the first group are properties such as tensile strength, modulus of elasticity, internal damping capacity, energy absorption capacity, or even properties which are a function of the raw material used and the selected processing. Belonging to the second group are properties such as cross section, diameter or mass etc. of the yarn. A signal indicating the charging voltage of the capacitor 18 is applied to the input 27. From the signals of the inputs 27 and 28, the control 26 determines whether the switching element 22 needs to be opened, for example because the capacitor 18 is sufficiently charged according to the present cross section and material of the yarn. The switching element 17 is closed when a cut is to be carried out, which is triggered by the control 26 or another element. The coil 3 is then excited by the voltage in the line 15, so that the plunger-type armature 4 moves towards the anvil 7 in FIG. 1 and the blade 6 forces the yarn 9 against the surface 8 where the yarn is cut. After a time which is sufficient for a cut, e.g. after 10 milliseconds, the switching element 17 is opened again via the line 25. Subsequently, the switching element 22 is closed again via the line 24, until the capacitor 18 again has the desired charging voltage. The charging voltage is then adapted if it is proportional to the resistance with which the yarn opposes the cut by the blade. This resistance is high if the yarn has a large cross section, i.e. if it has many and/or thick or tough fibres, or is small if the yarn has a small cross section, i.e. if it has few and/or thin or soft fibres. By way of a suitable input via the data input 30, it is also possible to take into account further factors dependent upon the material used. For example, the tensile strength or hairiness of the yarn measured in advance in the laboratory, or any other property which influences the force required for a cut. In this manner, the kinetic energy can be supplied to the blade in metered fashion and can be measured as a function of the cross section or other properties of the yarn. The cross section is measured prior to cutting, for example, and the measurement value obtained in this manner is used by the control 26 to measure the kinetic energy. The kinetic energy is therefore stored in advance as electrical voltage, for example in the capacitor 18. In this respect, the electrical voltage can not only be adapted to the cross section of the yarn, but also to the mass of the blade 6 and further moved parts 4, 5 or other properties of the drive.

The device can also be constructed in such a manner that the function of the switching element 22 is recorded in the voltage transformer 20. In this case, the switching element 22 is omitted and the line 24 connects the control 26 directly to the voltage transformer 20.

What is claimed is:

1. In a method of making sequential cuts of a yarn being processed in a textile machine provided with a cutter blade and means for imparting kinetic energy to the blade to cause the blade to cut the yarn, the steps comprising:

determining the amount of energy appropriate for cutting the yarn based upon a property of the yarn;

charging a capacitor to store therein before a first cut is to be made a first amount of energy corresponding to the predetermined amount;

discharging the capacitor to release the stored energy and converting such energy to kinetic energy driving a first cutting stroke of the blade; and recharging the capacitor before a second cut is to be made.

2. Apparatus for cutting yarn on a textile machine comprising:

a stationary anvil, a blade moveable from a withdrawn position in which the blade is spaced from the anvil to permit of passage of the yarn between said blade and said anvil to a cutting position in which said blade contacts said anvil to sever the yarn, a solenoid for driving said blade from said withdrawn position toward said anvil, a capacitor for storing energy for energizing said solenoid to drive said blade, means for connecting said capacitor to said solenoid when a cut is to be made and disconnecting said capacitor from said solenoid at other times, and circuit means for charging said capacitor when said capacitor is disconnected from said solenoid with an amount of energy determined in view of at least one property of the yarn to be appropriate for cutting the yarn.

* * * * *